United States Patent [19]

Inano et al.

[11] Patent Number: 4,600,116

[45] Date of Patent: Jul. 15, 1986

[54] TAPE-MOUNTED ELECTRONIC COMPONENTS ASSEMBLY

[75] Inventors: Mitsumasa Inano, Kyoto; Masaaki Okane, Takefu, both of Japan

[73] Assignee: Murata Manufacturing Co., Ltd., Kyoto, Japan

[21] Appl. No.: 680,648

[22] Filed: Dec. 11, 1984

[30] Foreign Application Priority Data

Dec. 19, 1983 [JP] Japan ..... 58-240348
Dec. 19, 1983 [JP] Japan ..... 58-240349

[51] Int. Cl.[4] ..... B65D 73/02

[52] U.S. Cl. ..... 206/330; 206/331; 206/344; 206/345

[58] Field of Search ..... 206/330, 344, 345, 331

[56] References Cited

U.S. PATENT DOCUMENTS

| | | | |
|---|---|---|---|
| 2,495,734 | 1/1950 | Katzman et al. | 206/330 |
| 4,092,626 | 5/1978 | Bergersen | 206/330 |
| 4,415,765 | 11/1983 | Iwasa et al. | 206/330 |
| 4,453,633 | 6/1984 | Hamuro et al. | 206/330 |

*Primary Examiner*—Joseph Man-Fu Moy
*Attorney, Agent, or Firm*—Wenderoth, Lind & Ponack

[57] ABSTRACT

An electronic components assembly, in which electronic components provided with a lead terminal are taped so that they can be automatically inserted in a circuit substrate of an electronic instrument, is disclosed. A plurality of electronic components are mounted on a support tape at regular intervals by fixing said lead terminal onto said support tape.

Since said support tape comprises a synthetic resin tape and said tape is formed of a thermoplastic synthetic resin containing inorganic fillers, said synthetic resin tape is superior in dimensional accuracy, tensile strength and heat-resistance and the high-speed taping and automatic insertion of electronic components are achieved.

Where said support tape is formed of said synthetic resin tape together with an adhesive tape, said synthetic resin tape is subjected to surface treatments to improve the adhesion of said adhesive tape.

17 Claims, 9 Drawing Figures

TAPE-MOUNTED ELECTRONIC COMPONENTS ASSEMBLY

The present invention relates to an electronic components assembly in which electronic components, for example, resistors and condensers provided with a lead terminal are mounted on a tape at regular intervals.

An automatic inserting machine is used in order to mount electronic components provided with a lead terminal on a print substrate and electronic components are formed in the form of a tape mounted electronic components assembly, in which they are mounted on a tape at regular intervals, for the purpose of the automatic insertion thereof.

Figure 1:
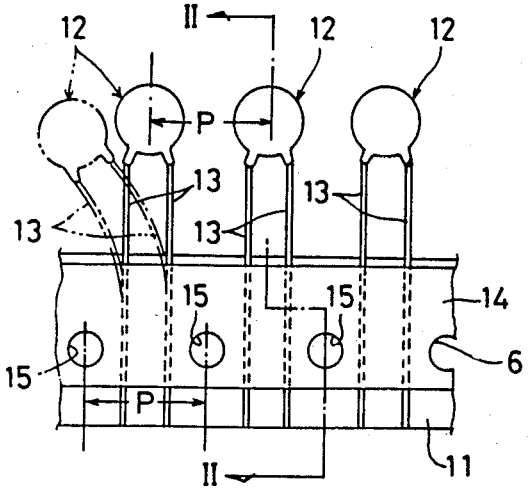
FIG. 1 PRIOR ART
Figure 2:
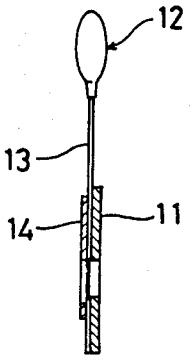
FIG. 2 PRIOR ART

Referring to FIGS. 1 and 2 showing the construction of the conventional tape-mounted electronic components assembly, a base tape 11 made of a cardboard such as Kraft liner is provided with lead terminals 13, 13 of a plurality of electronic components 12 arranged on one side thereof at regular pitches P, an adhesive tape 14 being stuck on said base tape 11 with holding said lead terminals 13, 13 between said base tape 11 and said adhesive tape 14 so that said lead terminals 13, 13 may be fixedly held between said base tape 11 and said adhesive tape 14, and said base tape 11 and said adhesive tape 14 being provided with guide holes 15 for transferring or positioning formed by punching along the direction of arrangement of said electronic components 12 at regular pitches P.

In the case of the above described tape-mounted electronic components assembly, in general, after each electronic components 12 is removed from a tape in an automatic production line of electronic instruments it is continuously mounted on a print substrate and the like of said electronic instruments.

Said electronic components assembly is adapted to be subjected to the positional detection by a photoelectric sensor and the like at many positions in the automatic inserting process of said electronic components 12 or the production process of said electronic components assembly.

However, since said conventional electronic components assembly is formed of a base tape 11 made of cardboard, as described above, paper dusts are produced from said base tape 11 due to the friction and the like in the transference of said electronic components assembly, whereby there is a problem that paper dusts are adhered to the luminous surface and the light-receiving surface of said photoelectric sensor to give a misoperation to said automatic inserting machine and the like. There is also a problem of an environmental pollution.

In addition, since an electronic components assembly of this type is housed in a box type container (not shown) in layers by folding at regular lengths when transported and stored, there is the possibility that said base tape 11 would be torn at said folded parts in said automatic inserting machine and the like.

Although it has been proposed that said base tape 11 is formed of synthetic resins instead of cardboards, synthetic resins have such disadvantages that they have a tensile strength less than that of cardboards (1), have an elongation larger than that of cardboards (2), and contain no functional groups, whereby showing no intimacy with the adhesives of said adhesive tape 14 (3). Accordingly, although, where said base tape 11 is formed of synthetic resins, the above described misoperation of photoelectric sensors, environmental pollution and the like due to paper dusts can be prevented, since synthetic resins are inferior to cardboards in tensile strength, said base tape 11 formed of synthetic resins is apt to be torn by an external force. In addition, there is the possibility that the position of said guide hole 15 would be shifted when a tensile force is given to said base tape 11 since synthetic resins have a large elongation percentage, whereby the accuracy is reduced. In addition, since the adhesion of synthetic resins to said adhesive tape 14 is not very strong due to the poor intimacy of synthetic resins with adhesives of said adhesive tape 14, there are such new problems that said electronic components 12 are unexpectedly inclined by an external force and the like as shown by an imaginary line in FIG. 1, whereby a base tape formed of synthetic resins has never been practically used so far.

Thus, it is an object of the present invention to provide a tape-mounted electronic components assembly which is superior in dimensional accuracy, tensile strength and heat- and cold-resistance, and also high-speed production and handling in an automatic inserting machine thereof can be achieved. In addition, the reliability of handling thereof can be improved.

It is another object of the present invention to provide an electronic components assembly which can prevent dusts, such as paper dusts, from being produced, and which has improved mechanical strength and adhesion, and which shows a high accuracy and a great holding power for electronic components.

It is a further object of the present invention to provide a comparatively inexpensive electronic components assembly.

The above and other objects and features of the present invention will appear more fully hereinafter from a consideration of the following description taken in connection with the accompanying drawings wherein one example is illustrated by way of example.

Figure 3:
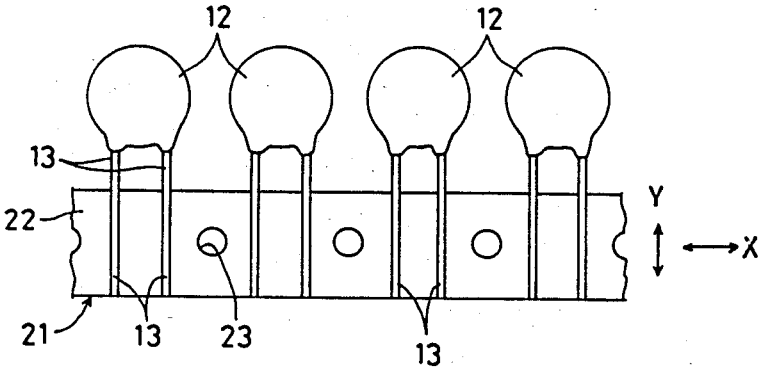
Figure 4:
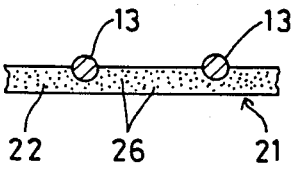
Figure 5:
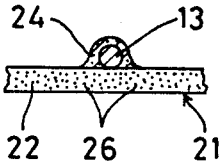
Figure 6:
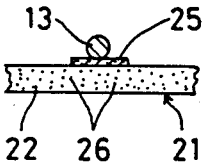
Figure 7:
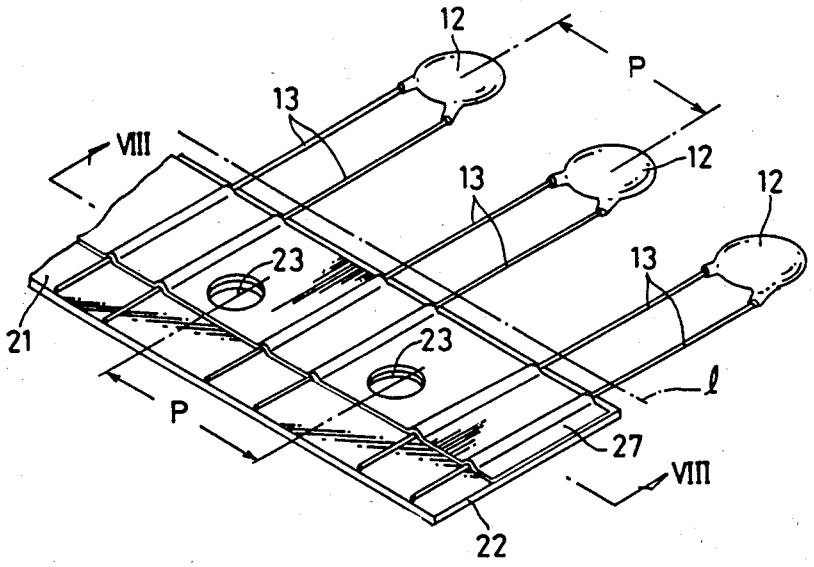
Figure 8:
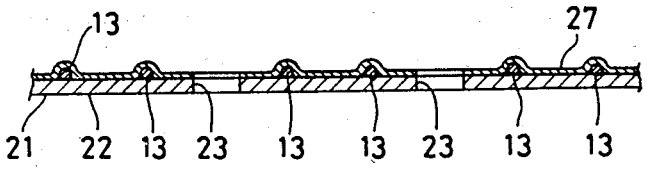
Figure 9:
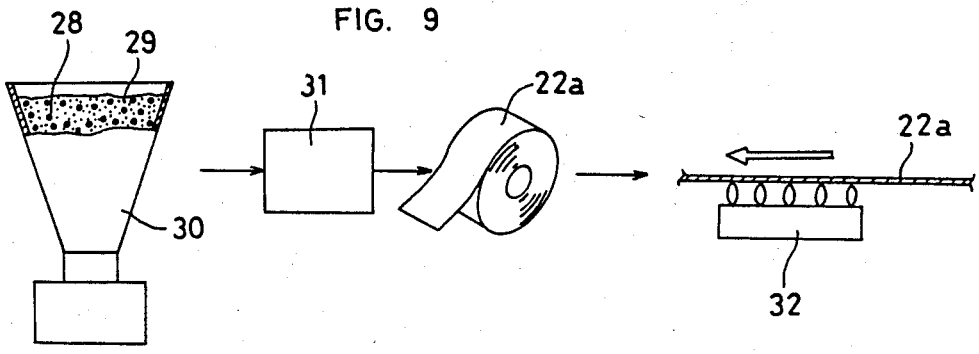

FIG. 1 is a front view showing the conventional tape-mounted electronic components assembly, FIG. 2 is a vertically sectioned side view showing the conventional tape-mounted electronic components assembly as shown in FIG. 1, FIG. 3 is a front view showing the first embodiment of a tape-mounted electronic components assembly according to the present invention, FIGS. 4 to 6 are sectional views showing different sectional constructions of said first embodiment of a tape-mounted electronic components assembly according to the present invention as shown in FIG. 3, respectively, FIG. 7 is a perspective view showing the second embodiment of a tape-mounted electronic components assembly according to the prezent invention, FIG. 8 is a sectional view taken along an arrow VIII—VIII in FIG. 7, and FIG. 9 is a summarized progress chart showing one example of the working operation of a base tape used in said second embodiment of a tape-mounted electronic components assembly according to the present invention.

At first, referring to FIGS. 3 to 6 showing the first embodiment of a tape-mounted electronic components assembly according to the present invention, a support tape 21, on which electronic components 12 are to be mounted, comprises a thermoplastic resin tape 22 containing inorganic fillers, lead terminals 13 of a large number of said electronic components 12 being fixedly mounted on said support tape 21 at regular intervals, and said support tape 21 being provided with perforations 23 formed at regular intervals.

A support tape 21 shown in FIGS. 3 and 4 is formed of a synthetic resin tape 22 singly and electronic components 12 are mounted on said synthetic resin tape 22 by placing lead terminals 13 of said electronic components 12 on said synthetic resin tape 22 and then heating them under the condition that said lead terminals 13 are pressed against said synthetic resin tape 22 to directly weld said lead terminals 13 to said synthetic resin tape 22.

Also, a support tape 21 shown in FIGS. 5 and 6 is formed of a synthetic resin tape 22 singly but different from one as shown in FIGS. 3 and 4 in the construction for mounting electronic components 12 thereon. In FIG. 5, said lead terminals 13 are mounted on said synthetic resin tape 22 by placing said lead terminals 13 on said synthetic resin tape 22 and applying adhesives 24 on said lead terminals 13 and said synthetic resin tape 22 so that said lead terminals 13 may be covered with said adhesives 24.

In FIG. 6, lead terminals 13 are mounted on a synthetic resin tape 22 by applying adhesives 25 on the upper side of said synthetic resin tape 22 and then placing said lead terminals 13 on said adhesives 25.

Said synthetic resin tape 22 is formed of thermoplastic synthetic resins containing various kinds of fillers. Said thermoplastic resins include vinyl-chloride, polystyrene, polyethylene, polyester, polypropylene and polyamide or the mixture of two or more kinds of these.

Said fillers 26 include one kind or more kinds of powdery and fibrous inorganic materials such as calcium carbonate, glass powders, silica, talc and clay. They are contained in said synthetic resin tape at a ratio of 5 to 80% by weight, preferably 10 to 60% by weight.

Since a synthetic resin tape 22 formed of thermoplastic resins containing fillers 26 is remarkably superior to a synthetic resin tape formed of thermoplastic resins, to which fillers are not added, in dimensional accuracy, tensile strength, heat-resistance and the like, high-speed taping and automatic insertion of electronic components assemblies can be achieved.

The characteristics of a synthetic resin tape formed of polypropylene as said synthetic resins containing calcium carbonate as said fillers 26 at a ratio of 20% by weight will be compared with those of a synthetic resin tape formed of polypropylene singly.

(A) Dimensional Accuracy

Where a synthetic resin tape is drawn in the longitudinal direction thereof by a force of 500 g at an interval of 20 cm, the elongation percentage of a synthetic resin tape according to the present invention is reduced to about half of that of a synthetic resin tape containing no filler.

(B) Tensile Strength

The tensile strength of a synthetic resin tape containing no filler amounts to merely 3.2 to 7.0 kg/mm$^2$. On the contrary, the tensile strength of a synthetic resin tape containing fillers was improved to 10.0 to 15.0 kg/mm$^2$.

(C) Heat-resistance

A synthetic resin tape containing fillers is durable up to 130° to 150° C. while a synthetic resin tape containing no filler is durable up to merely 100° to 110° C.

(D) Cold-resistance

A synthetic resin tape containing fillers is durable up to −20° C. while a synthetic resin tape containing no filler is durable up to merely to −5° to −10° C.

A stretched synthetic resin tape may be used in order to further improve said synthetic resin tape 22 in dimensional accuracy and tensile strength.

Either the uniaxial stretching for improving the strength in the longitudinal direction (X in FIG. 3) of a synthetic resin tape or the biaxial stretching for improving the strength in both the longitudinal direction and the direction of width (X, Y in FIG. 3) of a synthetic resin tape may be adopted.

The stretched synthetic resin tape 22 is remarkably superior to the unstretched synthetic resin tape in dimensional accuracy, tensile strength and more likely to achieve high-speed production and automatic insertion of the electronic components assemblies.

Next, in the second embodiment of a tape-mounted electronic components assembly according to the present invention, a support tape 21 comprises a thermoplastic synthetic resin tape 22 containing inorganic fillers and an adhesive tape 27 stuck on said tape 22 in combination, lead terminals 13 of electronic components 12 being put between said tape 22 and said adhesive tape 27, and perforations 23 for positioning being formed between lead terminals of adjacent electronic components 12.

Said synthetic resin tape 22 is formed of resin materials such as thermoplastic resins containing inorganic fillers and at least one side thereof, to which said adhesive tape 27 is stuck, is subjected to a surface treatment to improve the bonding capacity.

FIG. 9 is a summarized progress chart showing one example of the working operation of a synthetic resin tape 22. Referring now to FIG. 9, thermoplastic resin materials 28 used in said synthetic resin tape 22 include, for example, polypropylene which is inexpensive and superior in workability. However, since polypropylene shows insufficient tensile strength, bending strength and elongation percentage and is remarkably inferior in its intimacy with the adhesives of said adhesive tape 27 due to the absence of functional groups therein, that is to say, it is remarkably inferior in bonding capacity, inorganic fillers 29 are added to polypropylene 28 to impart functional groups to said tape 22 itself to some extent, and in addition, improve the tensile strength, bending strength and elongation percentage thereof. For example, calcium carbonate ($CaCO_3$), which is inexpensive and superior in practical usefulness, is used as said inorganic fillers 29. To illustrate a method of compounding more concretely, powdery calcium carbonate is added to said powdery polypropylene 28 at a ratio of 5 to 80% by weight, preferably 10 to 60% by weight, and the mixture is heated to blend in a mixer 30. Then, the resulting compound is molded in a molding machine 31 to give the appointed shape and size. The molded sheet is formed with a tape to obtain a half-finished good **22*a* of said synthetic resin tape 22. At this time, surfactants (not shown) may be put in said mixer 30 in order to uniformly disperse calcium carbonate 29** in said polypropylene.

Not only the above described tensile strength, bending strength and elongation percentage can be improved but also functional groups are formed on the surface of said synthetic resin tape 22, whereby comparatively superior bonding capacity is given to said synthetic resin tape 22. However, in order to further improve the bonding capacity to give sufficient durability required for the final products, one side of said synthetic resin tape 22 is subjected to a surface treatment. For example, an easily practicable flame treatment is adopted as this surface treatment. That is to say, the appointed surface of said synthetic resin tape 22 is oxidized to form a sufficient amount of functional groups near said surface by transporting said synthetic resin tape 22 over a flame of a gas burner 32 having temperatures of 1000° to 2500° C., preferably 1500° to 2000° C., at a high speed.

In addition, since the functional groups can be prevented from being eliminated even after the compound is formed in the form of synthetic resin tape, whereby the effect of surface treatment is kept for along time by adding calcium carbonate 29 to polypropylene 28, said synthetic resin tape 22 can be easily controlled.

Also in this embodiment, vinyl chloride, polystyrene, polyethylene, polyamide, polyester or a mixture of two or more kinds of these materials can be used as said thermoplastic resin materials 28 in addition to said polypropylene. In addition, one kind or more kinds of powdery or fibrous inorganic materials such as glass powder, silica, talc and clay can be used as fillers in addition to calcium carbonate. At this time, a polyamide, a polyester and the like have functional groups per se and have practicable superior bonding capacities, which is capacity different from polypropylene. Even for said resin materials 28, which have sufficient bonding capacity per se, such as polyamides and polyesters it is necessary, to improve the mechanical strength and elongation percentage to add said inorganic fillers 29 to said resin materials 29. However, although the mechanical strength and the like can be improved by adding said inorganic fillers 29, the bonding capacity is reduced in comparison with that prior to the addition said inorganic fillers 29 it is necessary that the surface, on which said adhesive tape 27 is stuck, is subjected to surface treatment.

In addition to said flame treatment, physical treatments, such as corona discharge treatments and plasma etching treatments, chemical treatments such as treatments with acids and treatments with solvents, mechanical surface-roughening treatments by sanding and the like can be adopted as the surface-treating means of said synthetic resin tape 22.

Thus, the constructed electronic components assembly according to the present invention are housed in a box-like container (not shown) in the transportation and storage thereof under the condition that they are folded at the appointed lengths or wound around a reel (not shown). In their use, for example, in the production line of electronic instruments, said perforations 23 are engaged with the positioning means of an automatic inserting machine (not shown) to transfer said electronic components assembly to the appointed position, said lead terminals 13, 13 being cut at the midway portion as shown by a one point chain line l in FIG. 7, and then only said electronic components 12 being separated and inserted in a circuit substrate of an electronic instrument.

Since, as described above, a support tape, on which lead terminals of an electronic components are mounted, comprises a synthetic resin tape, said synthetic resin tape being formed of thermoplastic synthetic resins to which inorganic fillers are added, the dimensional accuracy and tensile strength of said support tape can be remarkably improved in comparison with those of a conventional resin tape, and in addition, the high-speed production and handling of electronic components in an automatic inserting machine as well as the fidelity of the automatic insertion of electronic components can be improved.

Furthermore, since heat-resistance and cold-resistance of a support tape can be improved, the quality of a tape-mounted electronic components assembly does not show deterioration even under a high-temperature or low-temperature working environment.

In addition, since a support tape is formed of a synthetic resin tape, dusts can be prevented from being produced differently from the case where cardboards are used, whereby the control of an automatic inserting machine and the like by means of sensors can be surely achieved, and as a result, an automatic production and insertion can be achieved.

What is claimed is:

1. In a tape-mounted electronic components assembly comprising a support tape on which lead wires of a large number of electronic components are mounted, the improvement wherein the support tape is a synthetic resin tape, formed from thermoplastic synthetic resins to which inorganic fillers have been added and which inorganic fillers are uniformly distributed throughout the thermoplastic resins.

2. A tape-mounted electronic components assembly as set forth in claim 1, in which the thermoplastic synthetic resins are made from vinyl chloride, polystyrene, polyethylene, polypropylene, polyamide or polyester or mixtures thereof.

3. A tape-mounted electronic components assembly as set forth in claim 1, in which the inorganic fillers are powdery or fibrous inorganic materials selected from the group consisting of calcium carbonate, glass powder, silica, talc and clay.

4. A tape-mounted electronic components assembly as set forth in claim 1, in which said inorganic fillers are present in said synthetic resin tape in an amount of 5 to 80% by weight.

5. A tape-mounted electronic components assembly as set forth in claim 1, in which said synthetic resin tape is a uniaxially stretched tape.

6. A tape-mounted electronic components assembly as set forth in claim 1, in which said synthetic resin tape is a biaxially stretched tape.

7. A tape-mounted electronic components assembly as set forth in claim 1, in which said support tape is formed of said synthetic resin tape and an adhesive tape in combination.

8. A tape-mounted electronic components assembly as set forth in claim 7, in which said support tape is formed of said synthetic resin tape and said adhesive tape in combination, the surface of said synthetic resin tape being subjected to surface treatments in order to improve the bonding capacity for said adhesive tape.

9. A tape-mounted electronic components assembly as set forth in claim 8, in which said synthetic resin tape is formed of resins showing superior bonding capacity, said synthetic resin tape being subjected to surface treatments to compensate for any deterioration in the bonding capacity thereof due to the addition of said inorganic fillers.

10. A tape-mounted electronic components assembly as set forth in claim 8, in which any of a flame treatment, a corona discharge treatment, a plasma etching treatment, treatment with acids, treatment with solvents and sanding is used to surface treat said synthetic resin tape.

11. A tape-mounted electronic components assembly as set forth in claim 10, in which the surface of said synthetic resin tape is oxidized by a flame treatment, said flame treatment being carried out by a high-speed transference of said synthetic resin tape over a flame having temperatures of 1000° to 2500° C.

12. A tape-mounted electronic components assembly as set forth in claim 1, in which said inorganic fillers are present in said synthetic resin tape in an amount of 10 to 60% by weight.

13. A tape-mounted electronic components assembly as set forth in claim 10, in which the surface of said synthetic resin tape is oxidized by a flame treatment, said flame treatment being carried out by a high-speed transference of said synthetic resin tape over a flame having temperatures of 1500° to 2000° C.

14. In a tape-mounted electronic components assembly comprising a support tape on which lead wires of a large number of electronic components are mounted, the improvement wherein the support tape is a synthetic resin tape formed from thermoplastic synthetic resins to which inorganic fillers have been added and which inorganic filers are uniformly distributed throughout the thermoplastic resins, said thermoplastic synthetic resins being selected from the group consisting of vinyl chloride, polystyrene, polyethylene, polypropylene, polyamide and polyester or mixtures thereof and wherein said inorganic fillers powdery or fibrous inorganic materials are selected from the group consisting of calcium carbonate, glass powder, silica, talc and clay, said inorganic fillers being present in said synthetic tape in an amount of 5 to 80% by weight.

15. A tape-mounted electronics assembly as set forth in claim 14 in which the inorganic fillers are present in the synthetic resin in an amount of 10 to 60% by weight.

16. A tape-mounted electronic components assembly as set forth in claim 15, in which any of a flame treatment, a corona discharge treatment, a plasma etching treatment, treatment with acids, treatment with solvents and sanding is used to surface treat said synthetic resin tape.

17. A tape-mounted electronic components assembly as set forth in claim 16, in which the surface of said synthetic resin tape is oxidized by a flame treatment, said flame treatment being carried out by a high-speed transference of said synthetic resin tape over a flame having temperatures of 1000° to 2500° C.

* * * * *